US006006815A

United States Patent [19]

Schanz

[11] Patent Number: 6,006,815

[45] Date of Patent: Dec. 28, 1999

[54] ROLLER SHUTTER MEMBER

[76] Inventor: Hans Schanz, Schulweg 5, 72226 Simmersfeld, Germany

[21] Appl. No.: 09/133,327

[22] Filed: Aug. 13, 1998

[30] Foreign Application Priority Data

Aug. 26, 1997 [DE] Germany ..... 197 37 534

[51] Int. Cl.[6] ..... E06B 9/08

[52] U.S. Cl. ..... 160/133; 160/229.1; 160/231.2; 160/235; 16/261; 16/270

[58] Field of Search ..... 160/133, 229.1, 160/231.1, 231.2, 233, 235, 236; 16/261, 270, 355

[56] References Cited

U.S. PATENT DOCUMENTS

| | | | |
|---|---|---|---|
| 3,216,102 | 11/1965 | Vecchiarelli | 160/235 |
| 4,433,714 | 2/1984 | Barber | 160/235 |
| 4,470,444 | 9/1984 | Riexinger | 160/235 |
| 4,628,982 | 12/1986 | Labelle | 160/235 |
| 4,723,588 | 2/1988 | Ruppel | 160/235 |
| 4,771,816 | 9/1988 | Clay, Jr. | 160/235 |
| 4,846,247 | 7/1989 | Kessler | 160/235 |
| 4,930,561 | 6/1990 | Clay | 160/229.1 |
| 4,972,894 | 11/1990 | Machill | 160/235 |
| 4,979,553 | 12/1990 | Lowry, III et al. | 160/235 X |
| 5,204,147 | 4/1993 | Schneider | 160/235 X |
| 5,842,508 | 12/1998 | Krupke et al. | 160/235 |

FOREIGN PATENT DOCUMENTS

| | | | |
|---|---|---|---|
| 1659464 | 10/1969 | Germany | 160/235 |

*Primary Examiner*—Daniel P. Stodola
*Assistant Examiner*—Bruce A. Lev
*Attorney, Agent, or Firm*—Browdy and Neimark

[57] ABSTRACT

A roller shutter member for a roller shutter arrangement, which comprises individual, articulatingly connected slats, each slat being connected at one of its two connected longitudinal sides with a hook joint rail and at its other connected longitudinal side with a hook receiving channel. The hook receiving channels are provided with sealing rails. The hook-like joint rails are thrust in a sealing manner against the sealing rail in the flat region on the roller shutter member when the slats are extended in a linear form so that a sealed roller shutter member is formed.

9 Claims, 1 Drawing Sheet

ROLLER SHUTTER MEMBER

BACKGROUND OF THE INVENTION

The invention relates to a roller shutter or blind member for roller shutter arrangements, which comprises individual, articulatingly connected slats, each slat being connected at one of its two connected longitudinal sides with a hook-like joint rail and at its other connected longitudinal side with a hook receiving channel.

THE PRIOR ART

Such roller shutter members are commercially available in many different types, the slats being manufactured of plastic or a light metal. In order to form the roller shutter member the slats are fitted together into each other or interlocked, that is to say a respective hook-like joint rail is inserted into the hook receiving channel of the adjacent slat.

Owing to the relatively loose connection in the form of a mechanical joint between the slats it is impossible to produce a rain-proof sealing effect. This is furthermore unnecessary in many cases, since rainwater can drain off on the outer side of the slats, the fitting of parts of the slats into each other leading actually to the creation of a sort of labyrinth seal. However problems do occur in the case of sloping or horizontally placed roller shutter members or in the case of locations with extreme climatic conditions, where wind and rain frequently beat against closed roller shutters practically horizontally. For such cases conventional roller shutter members are not sufficiently protected against water, which works its way in between the slats.

SHORT SUMMARY OF THE INVENTION

One object of the invention is to so improve known roller shutter members that a water-tight roller shutter surface is formed.

In order to achieve these and/or other objects in the present invention, the hook receiving channels are provided with sealing rails and the hook-like joint rails are, at least in flat regions of the roller shutter member with the slats stretched out linearly, thrust in a sealing manner against the sealing rails.

Owing to the arrangement of the invention it is now possible in a simple and economical manner for a watertight roller shutter surface to be produced, it being possible furthermore for existing roller shutter members to be adapted to have such a water-tight surface given a suitable design of the joint rails and the hook receiving channels. By thrusting the hook-like joint rails against the sealing rails in the linearly stretched out portions of the roller shutter member there will be a stiffening effect, by which rattling noises are also substantially reduced. If on the other hand the roller shutter member is wound up on a take/up shaft in the roller shutter chest, the joint rails will come clear of the sealing rails so that a simple and adaptable rolling operation may be performed without interfering frictional effects. On unrolling from the take-up shaft the water proofing effect is then immediately restored, if the roller shutter member is moved back into its linear state forming the roller shutter surface.

A particularly advantageous design in accordance with the invention is such that the hook-like joint rails fit through slot-like openings in the hook receiving channels and into the channels so that end edges of the joint rails furthermore engage abutment elements in such a manner that respectively on pivoting of two hooked together slats in the linear stretched out position the end edge of the joint rail constitutes the pivot axis and the curved hook part of the joint rail is pivoted more and more into the interior space of the hook receiving channel against the sealing rail. The sealing action is then practically enhanced by leverage, this meaning that there is a particularly efficient sealing effect. On rolling up the roller shutter member onto the take-up shaft the sequentially consecutive slats are automatically moved into a curved configuration so that the joint rails automatically separate from the sealing rails with a lever effect.

The abutment elements are preferably designed in the form of rail elements arranged substantially transversely in relation to the plane of the slats, and closing the hook receiving channels apart from the slot-like openings, such rail elements more particularly representing counter hook elements.

The sealing rails are preferably designed in the form of elastic sections and more particularly hollow sections in order to permit a soft, elastic thrusting in of the joint rails.

The sealing rails are arranged on the inner end regions of the hook receiving channels in order to provide a certain amount of free space for the joint rail, more particularly on rolling up the roller shutter member.

Together with their joint rails and hook receiving channels the slats are preferably designed in the form of integral moldings or shapes and are either formed by suitably shaped strips of sheet metal or are in the form of extrudes.

Further advantageous developments and convenient forms of the invention will be understood from the following detailed descriptive disclosure of one embodiment thereof in conjunction with the accompanying drawings.

DETAILED ACCOUNT OF WORKING EMBODIMENT OF THE INVENTION

Figure 1:
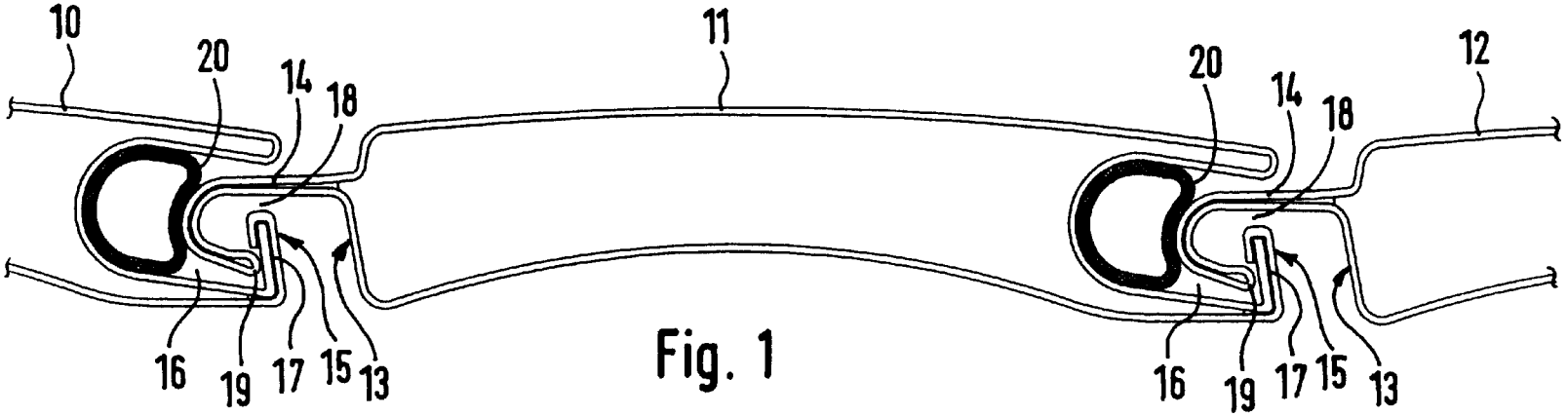
FIG. 1 shows three connected together slats of a roller shutter member or element in the extended, sealing condition thereof.

The three slats 10 through 12 illustrated in the two figures are designed in the form of hollow sections, only the middle slat 11 being depicted fully, whereas the two adjacent slats 10 and 12 are merely illustrated in part. The rail-like slats possess a substantially rectangular cross section in a flat form, the flat side being respectively slightly curved. These slats 10 through 12 are respectively made by bending a piece of sheet metal strip and consist for instance of a light weight metal or light weight metal alloy. It is naturally possible as well to manufacture the slats as extrudes and furthermore manufacture them of plastic.

Since all slats 10 through 12 are identical in structure, only the middle slat 11, which is completely illustrated, will be described. At its left hand connecting side 13 the slat 11 possesses a hook-like joint rail 14, which is molded on integrally, whereas on the oppositely placed side 15 a hook receiving channel 16 is arranged. When the slats are joined together or hooked up, the respective joint rail 14 of the one slat fits into the hook receiving channel 16 of the other slat so that an articulating joint is formed. The hook receiving channel 16 is closed apart from a slot-like opening 18 for the joint rail 14 to fit through. The abutment element 17 extends in this respect from one limiting edge of the hook receiving channel 16 substantially perpendicularly to the flat sides of the slat 11, a small oblique region, directed toward the interior of the hook receiving channel 16 causing there to be a hook-like shape of the abutment element 17. The hook-like joint rails 14 are so placed that their hook edge 19 abuts the abutment element 17 of the respectively adjacent slat.

In the interior, that is to say on the "floor" of the groove-like hook receiving channel 16 a respective sealing rail 20 is arranged, which is designed in the form of an elastic section and more particularly as a hollow section. Solid designs having a suitable degree of elasticity are naturally possible as well. Furthermore it is possible for elastic sections adapted to the configuration of the hook receiving channel 16 to be employed.

Figure 2:
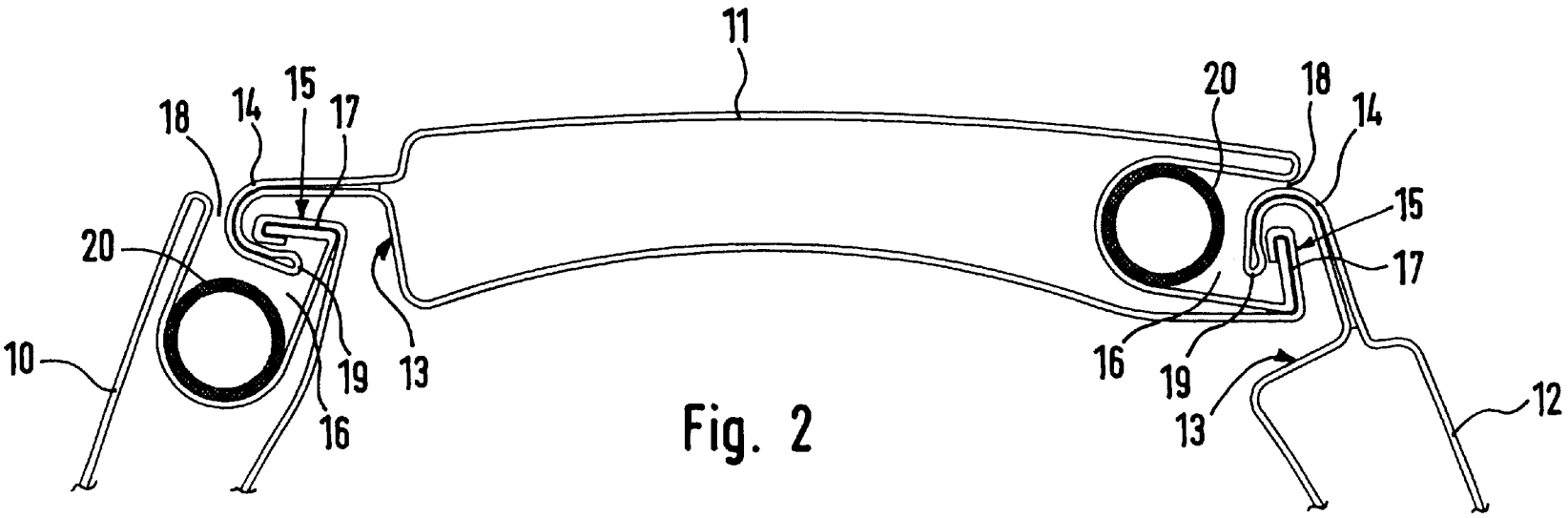
FIG. 2 shows the same three slats on winding up onto a take-up shaft in the non-sealing condition.

In the curved state of the roller shutter member as shown in FIG. 2, that is to say for example in the condition wound up on the take-up shaft, the end regions of the hook-like joint rails rest flatly against the respective abutment elements 17 so that there is no contact with the sealing rails 20 and consequently during winding up there will be no troublesome frictional effect owing to the sealing rail 20. However as soon as the roller shutter member after unwinding takes the form of a flat, even roller shutter surface with the slats extended to be linear as illustrated in 1, the joint rail 14, whose end edges rest against the abutment elements 17, will be pivoted inward and thrust against the sealing rails 20, the sealing rails 20 being correspondingly deformed. The result of this that there is a complete sealing effect in the roller shutter member, the elastic stiffening of the sealing rails 20 also preventing rattling of the roller shutter member.

For the production of such a roller shutter member it is merely necessary to insert the sealing rails 20 into the hook receiving channels 16 and be either jammed permanently in place or bonded, it only being necessary for the individual slats to be fitted together. Cutting off to the desired width of the roller shutter can then be performed at some later time.

What is claimed is:

1. A roller shutter arrangement comprising:

a plurality of articulated connected slats;

each of said slats having a hooked shaped joint rail along a first longitudinal edge and a hook receiving channel along a second longitudinal edge;

the hook receiving channel having a sealing rail engaged in a bottom thereof and an abutment element projecting from an end of a first side of each of said slats toward a second side of each of said slats;

a space being provided between said abutment element and said sealing rail;

a longitudinal slot located between a free end of said abutment element and an end of said second side;

the hooked shaped joint rail of each slat of said slats fitted through said slot of an adjacent slat of said slats and into said space between said abutment element and said sealing rail;

wherein, a free end of the hooked shaped joint rail is engageable on said abutment element;

wherein, when said free end of said hooked shaped joint rail of each said slat is engaged against said abutment element with said hooked shaped joint rail between the sealing rail and the abutment element of each said adjacent slat and when each said slat is rotated into a plane of the adjacent slat, an apex of said hooked shaped joint rail compresses said sealing rail to create a seal between said slats as the hooked shaped joint rail gradually moves toward the bottom of said hook receiving channel and the slats are moved into a common plane.

2. The roller shutter arrangement as set forth in claim 1, wherein the abutment element is transverse to a plane of the slats.

3. The roller shutter arrangement as set forth in claim 2 wherein the abutment element serves as a counter hook element.

4. The roller shutter arrangement as set forth in claim 1, wherein the sealing rail is an elastic section.

5. The roller shutter arrangement as set forth in claim 4, wherein the sealing rail is hollow.

6. The roller shutter arrangement as set forth in claim 1, wherein the sealing rail is engaged to an inner end region of the hook receiving channel.

7. The roller shutter arrangement as set forth in claim 1, wherein the slats together with the joint rails and hook receiving channels are integral elements.

8. The roller shutter arrangement as set forth in claim 7, wherein the slats are strips of sheet metal.

9. The roller shutter arrangement as set forth in claim 7, wherein the slats are extruded.

* * * * *